United States Patent [19]

Cooper

[11] 4,114,950

[45] Sep. 19, 1978

[54] METHOD AND APPARATUS FOR BREAKING A HARD COMPACT MATERIAL SUCH AS ROCK OR CONCRETE

[75] Inventor: George Anthony Cooper, Gollion, Switzerland

[73] Assignee: Institut Cerac SA., Ecublens, Switzerland

[21] Appl. No.: 795,176

[22] Filed: May 9, 1977

[30] Foreign Application Priority Data

May 25, 1976 [CH] Switzerland ..... 6575/76

[51] Int. Cl.[2] ..... E21C 37/02; E21C 37/04

[52] U.S. Cl. ..... 299/15; 299/23; 173/91; 299/22; 173/46

[58] Field of Search ..... 299/15, 20–23; 85/68, 65; 294/86.23; 175/230; 173/91

[56] References Cited

U.S. PATENT DOCUMENTS

| | | | |
|---|---|---|---|
| 1,463,134 | 7/1923 | Haight | 173/91 X |
| 1,648,096 | 11/1927 | Wineman | 299/15 |
| 1,884,946 | 10/1932 | Wineman | 299/10 |
| 3,414,328 | 12/1968 | Darda | 299/22 |
| 3,488,093 | 1/1970 | Darda | 299/22 |
| 3,568,657 | 3/1971 | Gue | 173/91 X |
| 3,891,036 | 6/1975 | Schmidt | 173/91 |

FOREIGN PATENT DOCUMENTS

| | | | |
|---|---|---|---|
| 933,328 | 8/1955 | Fed. Rep. of Germany | 61/45 B |

*Primary Examiner*—Ernest R. Purser
*Assistant Examiner*—Nick A. Nichols, Jr.
*Attorney, Agent, or Firm*—Flynn & Frishauf

[57] ABSTRACT

A method for breaking a hard compact material such as rock or concrete. The method includes drilling a hole into the material, gripping a portion of the wall of the hole by applying a radially outwardly directed force thereto, and applying an axially outwardly directed force to the gripped region in order to cause cracks to arise in the wall of the hole. One of the forces is generated by means of sequentially repeated axially directed impacts. The apparatus for carrying out the method comprises a gripping means and a wedge means slidable relative to the gripping means. The gripping means and the wedge means have cooperating wedge surfaces. A rear extension member having a shoulder is attached to the wedge means. A hammer piston reciprocable in the apparatus housing delivers sequentially repeated axially directed impacts upon the shoulder.

12 Claims, 5 Drawing Figures

METHOD AND APPARATUS FOR BREAKING A HARD COMPACT MATERIAL SUCH AS ROCK OR CONCRETE

The invention relates to a method for breaking a hard compact material such as rock or concrete by drilling a hole thereinto, gripping a portion of the wall, and by applying impulsive axially outwardly directed and radially outwardly directed forces to the gripped region, and an apparatus for performing the method.

The method for breaking hard compact material such as rock or concrete can be applied e.g. in driving tunnels, splitting boulders or pieces of rock or concrete, or in flaking material from thick seams.

In Swiss patent application No. 13751/75 (corresponding to U.S. application Ser. No. 731,316, filed Oct. 12, 1976) now U.S. Patent No. 4,099,784, issued July 11, 1978 there is described an apparatus for gripping a region of material for the wall of a borehole with a radially outwardly directed force, and simultaneously or subsequently applying an axially outwardly directed force. This apparatus is designed to exert a steady load which can be maintained, decreased or increased at will by adjusting the hydraulic pressure with which its working cylinders are provided. In this apparatus, the reaction to the outward axially directed force is transmitted by a thrust-transmitting member passing coaxially through the wedge means and gripping means, and acting on the bottom of the borehole.

It is the object of the present invention to remove the necessity for this thrust-transmitting member, and to show the benefits which may be obtained thereby.

SUMMARY OF THE INVENTION

This object is achieved according to the invention in such a way that at least one of said forces is generated by means of sequentially repeated axially directed impacts.

The apparatus for carrying out the method is, according to the invention, characterized by a rear extension member attached to said wedge means and projecting out of the hole, a shoulder on said rear extension member, and a hammer piston reciprocable in the apparatus housing, said hammer piston being arranged to deliver sequentially repeated axially directed impacts upon said shoulder.

DETAILED DESCRIPTION

Figure 1:
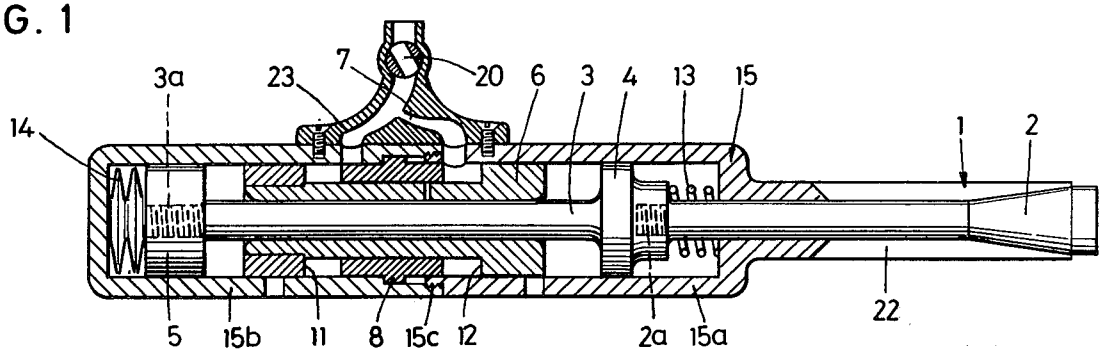
FIG. 1 shows a longitudinal section of the inventive of the present invention apparatus for breaking compact material such as rock or concrete.

Thus, FIG. 1 shows an apparatus for breaking a hard compact material such as rock or concrete which comprises gripping means 1 to be introduced in a hole predrilled in a material to be broken and wedge means 2 which passes coaxially through the gripping means. The wedge means is connected by its threaded neck 2*a* outside the hole with a rod 3 provided with a collar 4 and a threaded neck 3*a* screwed in another collar 5, upon which rod slides an impactor 6. If the impactor 6 is accelerated along the rod 3 between the two collars 4, 5 in an axially outward sense, it will impact on the external collar 5 and will transmit a tensile shock to the rod 3. This shock will be communicated to the wedge means 2 and will tend to pull the wedge means into the gripper means 1, which will thereby exert a radially outwardly directed force on the material to be broken. Simultaneously, because the wedge means is being pulled into the gripper means, this pulling impulse will also be communicated to the material to be broken.

The ratio between the magnitude of the radially outward and axially outward directed forces will depend upon the angle of the wedge means, and the coefficient of friction between the wedge means 2 and the gripper means 1. If this angle is sufficiently small (less than about 10°), then, after the impulsive loading, the wedge means 2 will not return to its original position, but will remain to exert a steady radial outward directed force on the gripper means 1 and hence on the material to be broken. The effect of repeating the impact process will be to progressively drive the wedge means 2 further into the gripper means 1, with a corresponding stepwise increase in the radially outwardly directed force. Simultaneously, at the moment of each impact the gripper means and the material to be broken are loaded with an impulsive axially outwardly directed force. Both the radial and axial outwardly directed forces are useful to the material breaking process.

There are several advantages of this invention over the machine described in said U.S. application Ser. No. 731,316.

(1) No space in the borehole is taken by the thrust-transmitting member, and thus, for the transmission of a given breaking force, a borehole of approximately half the cross-sectional area may be used as with a thrust-transmitting member, or alternatively, more useful force may be exerted in a hole of given diameter. This will result in substantial economics in hole drilling cost and time.

(2) Since the outward axially directed force is generated impulsively, there is no need for a thrust member to transmit the reaction force generated by the outward axially directed force, and hence no need to exert force on the hole bottom. Such an invention would be useful in a deep hole, or in a hole completely penetrating, for example a wall or floor of a building.

(3) An impulsive force of a given magnitude may in general be generated from a machine lighter in weight than that necessary to generate a static force of the same magnitude (compare the weight of a hammer to drive a nail with a press required to drive the same nail with a steady force: note also that there is again no need to absorb a reaction force).

It is thus expected that a machine according to the present invention will be lighter and more simple than one made according to said Swiss patent application No. 13751/75.

(4) It is found that hard compact material such as rock or concrete may be broken by repeated outwardly directed blows as described, even if the maximum force in any blows is less than that necessary to break the material with a single steady pull. This is a novel and unexpected feature of the invention which makes such a machine more effective than a counterpart which exerts only steady forces.

In a preferred embodiment (FIG. 2) there are provided equally two collars 4, 5 (see FIG. 1) limiting the travel of the impactor 6, which takes the form of a piston sliding in the cylindrical body 15 of the apparatus, which body comprises two parts 15*a*, 15*b* screwed together at 15*c*. Air or hydraulic means for actuating the impactor 6 is switchable to drive the impactor against either collar 4, 5. In addition, the wedge means 2 is provided with a forward extension 19 carrying a drill bit 16 at its forward end. By switching means 8 the impactor 6 is made to move reciprocally between the two collars 4, 5 and by throttling means 17 the impact is made more violent on one or other of the collars 4, 5.

Figure 2:
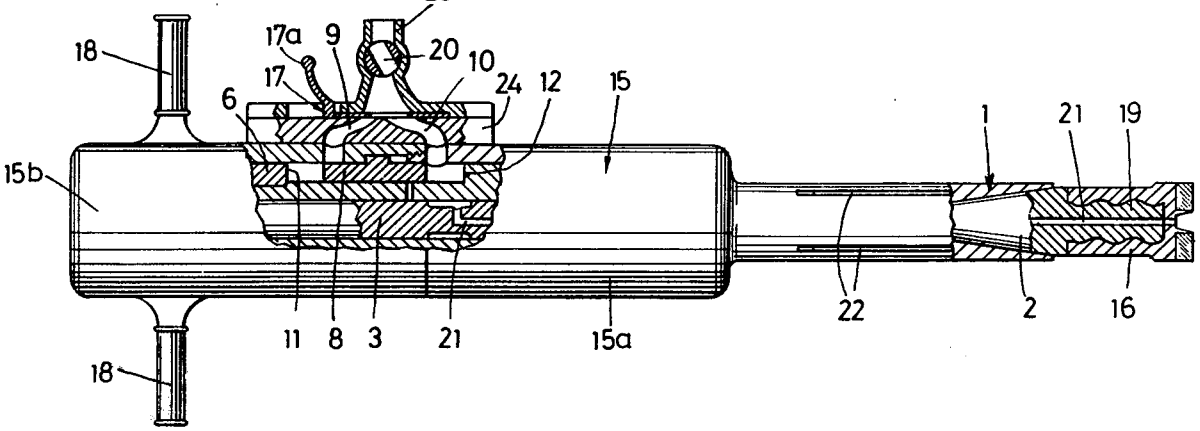
FIG. 2 shows a longitudinal section of a preferred embodiment of the apparatus according to FIG. 1.

Reference to FIG. 2 shows that the switching means 8 may, for example, be a slide valve actuated by the movement of the impactor 6 in such a way as to direct the flow of working fluid (e.g., compressed air) sequentially through either of two inlet ports 9, 10, of an intermediate piece 24 lying between an inlet connecting piece 23 and the body 15, and hence to generate the reciprocal motion of the impactor. In FIG. 2, the impactor 6 is shown during its downward motion. Working fluid is admitted through the port 10. When an upper annular surface 11 of the impactor 6 hits the valve 8, the latter is caused to shift. After having delivered an impact upon the collar 4, the impactor 6 rebounds. The valve 8 is retained in its forward position due to the pressure acting on its rear end face. The working fluid through the port 9 now acts on the surface 11 whereby the impactor 6 is caused to move upwards. When another annular surface 12 of the impactor 6 hits the valve 8, the latter shifts back to its position shown in FIG. 2. After having delivered an impact upon the collar 5, the impactor 6 rebounds. The valve 8 is retained in its position shown in FIG. 2 due to the pressure acting on its lower end face. The working fluid is now admitted through the port 10 and acts on the surface 12 of the impactor 6 whereby the impactor is caused to move downwards. The throttling means 17 may also be a slide valve arranged in such a way as to partially obstruct one or other of the two entry ports 9, 10, and hence to cause a reduced energy to be delivered to the impactor in one sense or the other.

With the throttling means 17 in a position towards the drill bit, the impact will be heavy in the direction towards the rock, while the energy delivered in the other direction is only sufficient to return the impactor 6 to the opposite end of the cylinder ready for the next impact stroke. With the throttling means 17 in this position, the apparatus will be able to drill a hole into the material to be broken. With the throttling means 17 in a position away from the drill bit 16, the impact will be heavy in the opposite direction, and will thus serve to perform the breaking action.

In the apparatus shown in FIG. 1, there is no need for an adjustable throttling means, as the impact should always be lighter in the inward direction. This can be arranged by a fixed constriction 7 in the air passage.

Resilient means 13 and 14 (FIG. 1) are provided to limit the travel of the wedge means 2 and collars 4, 5 relative to the apparatus body 15. These resilient means may be flat or coil springs, or may take the form of hydraulic or pneumatic dampers. In the case of the external spring 14 its degree of compression will depend on the amount that the wedge means 2 has been advanced into the gripping means 1. In this way, if the spring 14 is made stiff, as the wedge means 2 is advanced, an increasing part of the impact energy delivered to the collar 5 by the movement of the impactor 6 towards the collar 5 will pass through the spring 14 to the body 15 and hence be communicated to the gripping means 1 as an axial impulse directed to the outside. This impulse will also be useful to the breaking process. By the use of the spring 14, therefore, the blow energy may be advantageously partitioned between the gripping and pulling forces: in the early stages of the breaking process, proportionately more of the blow energy goes to generating the gripping force, while later on, when the gripper means has opened and anchored itself in the material to be broken, more of the blow energy goes towards pulling outwards the material to be broken.

It is envisaged that the apparatus may be either rig-mounted or hand-held. In the latter case, a pair of bundles 18 may be attached to the body 15 of the apparatus for the convenience of the operator. Slits 22 separate the individual gripping means sections.

Figure 3A:
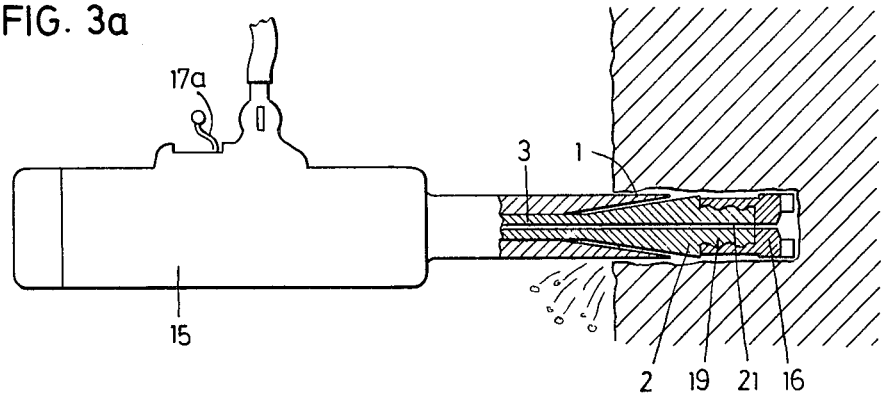
FIG. 3*a* shows an elevation of the apparatus partially in schematic and partially in section at the beginning of the drilling operation.
Figure 3B:
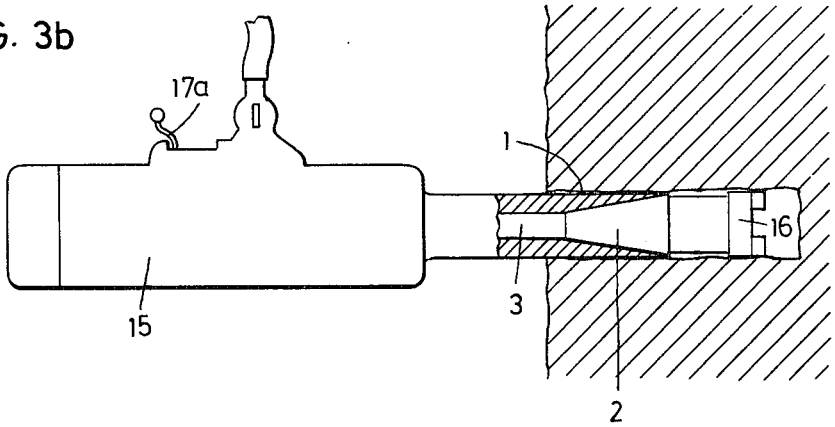
FIG. 3*b* shows an elevation of the apparatus according to FIG. 3*a* in partially schematic and partially in section when the borehole has been drilled.
Figure 3C:
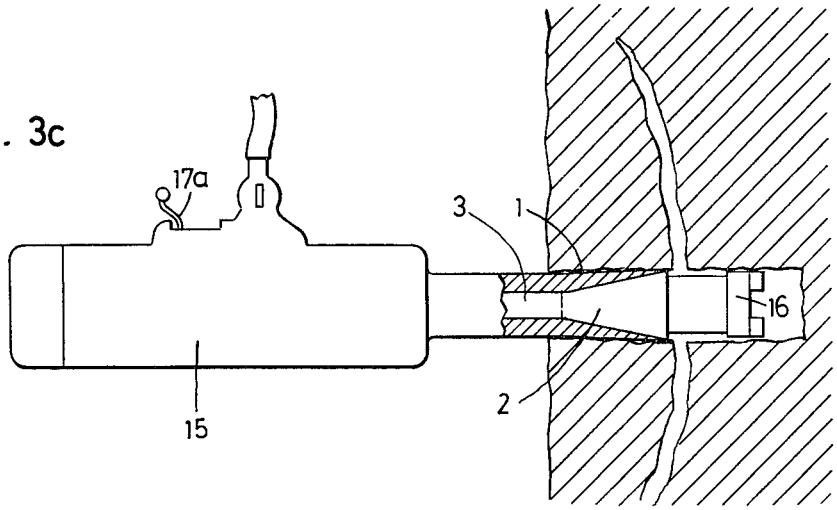
FIG. 3*c* shows an elevation of the apparatus according to FIG. 3*a* in a partially schematic and partially in section, whereby a radially outwardly directed force is applied on the gripped region of the hole wall due to the movement of the cone into the gripping means.

FIGS. 3*a*, 3*b*, 3*c* show a typical sequence of operation for the variant which is capable of drilling the hole. In FIG. 3*a*, the throttling lever 17*a* is in the forward position, so that the blow energy is high in the direction of the material to be broken . At this time, the cone is free of the gripper and the hole is drilled. In FIG. 3*b*, the hole has been completed, and the throttle lever 17*a* has been pulled back. The cone now enters the gripper, which takes a firm hold on the material to be broken. In FIG. 3*c*, still with the throttle 17*a* in the backward position, the combination of the outwardly directed impulses with the wedging action of the cone has resulted in the failure of the rock or concrete, which is being pulled away to leave a crater in the material. It should be noted that this is the expected failure mode when attacking a large volume of material. In the case of isolated blocks or boulders of small volume, failure may occur by the formation of radial cracks alone, being driven principally by the wedging force.

A central passage 21 (FIGS. 2 and 3) is provided for the passage of flushing means derived from the air used to drive the impacting mechanism. A stop cock is provided for the supply of working fluid.

Rotation of the drill bit 16 may be done either by the operator turning the apparatus by hand along its longitudinal axis or by an automatic rotation mechanism which is not shown.

What is claimed is:

1. In a method for breaking a hard compact material such as rock or concrete including drilling a hole into the material to be broken, gripping a region of the wall of the hole by applying a radially outwardly directed force thereto, and applying an axially outwardly directed tractive force to the gripping region in a direction axially outwardly of the hole and toward the mouth of the hole, said forces being of sufficient magnitude so as to cause cracks to arise in the wall of the hole, the improvement comprising generating at least one of said forces by sequentially repeated axially outwardly directed tractive impacts which are directed axially outwardly of the hole and toward the mouth of the hole.

2. A method according to claim 1, comprising at least partly transforming said impacts so as to generate said radially outwardly directed force.

3. A method according to claim 2, comprising applying said radially and axially outwardly directed forces simultaneously.

4. Apparatus for breaking a hard compact material such as rock or concrete having a hole drilled therein, comprising:

a housing, gripping means adapted to be inserted into a hole drilled in a material to be broken, wedge means slidable relative to said gripping means, said wedge means and said gripping means having cooperating wedge surfaces, said wedge means having a rear extension member projecting out of the hole and being at least partially in said housing, a shoulder on said rear extension member, said shoulder being in said housing, and a hammer piston reciprocable in said housing, said hammer piston being arranged to deliver sequentially repeated axially outwardly directed impacts upon said shoulder, which impacts are directed axially outwardly of the hole and toward the mouth of the hole.

5. Apparatus according to claim 4, wherein said gripping means is connected to the forward end of said housing.

6. Apparatus according to claim 4, wherein said cooperating surfaces of the wedge means and the gripping means converge outwardly from the hole.

7. Apparatus according to claim 4, further comprising a forward extension member attached to said wedge means, said forward extension member carrying a drill bit.

8. Apparatus according to claim 7, comprising a second shoulder on said rear extension member and located in said housing, said hammer piston being arranged to deliver compressive impacts upon said second shoulder during drilling by means of said drill bit, said impacts delivered upon said second shoulder being directed axially of the hole and inward toward the bottom of the hole.

9. Apparatus according to claim 8, wherein said hammer piston has opposing actuating faces and comprising means coupled to said housing for admitting pressurized fluid to either face of said hammer piston in order to move it reciprocally between said first and second shoulders.

10. Apparatus according to claim 4, wherein said hammer piston has opposing actuating faces, and further comprising means coupled to said housing for admitting pressurized fluid to either face of said hammer piston to move it reciprocally in said housing, and throttling means in the fluid flow path for obstructing the fluid flow to either of the faces of said hammer piston so as to cause a reduced energy to be delivered to said hammer piston in either sense.

11. Apparatus according to claim 9, wherein said pressurized fluid admitting means comprises valve means for alternately supplying said pressurized fluid to said faces of said hammer piston.

12. Apparatus according to claim 11, wherein said valve means is cooperatively coupled to said housing.

* * * * *

UNITED STATES PATENT AND TRADEMARK OFFICE

CERTIFICATE OF CORRECTION

PATENT NO. : 4,114,950

DATED : September 19, 1978

INVENTOR(S) : George A. COOPER

It is certified that error appears in the above-identified patent and that said Letters Patent are hereby corrected as shown below:

Column 1, line 58, change "3a in partially" to --3a partially in--;

line 61, change "3a in a partially" to --3a partially in--;

Column 4, line 46, after "A stop cock" insert --20--.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*